United States Patent [19]

Birkenmayer

[11] 4,141,544

[45] Feb. 27, 1979

[54] APPARATUS FOR LONGITUDINAL DEFORMATION, FOR EXAMPLE BY CREASING OR PERFORATION, OF PAPER WEBS PRIOR TO FOLDING

[75] Inventor: Helmut Birkenmayer, Augsburg, Fed. Rep. of Germany

[73] Assignee: Maschinenfabrik Augsburg-Nurnberg Aktiengesellschaft, Augsburg, Fed. Rep. of Germany

[21] Appl. No.: 829,820

[22] Filed: Sep. 1, 1977

Related U.S. Application Data

[63] Continuation of Ser. No. 780,672, Mar. 23, 1977, abandoned, which is a continuation of Ser. No. 596,448, Jul. 16, 1975, abandoned.

[30] Foreign Application Priority Data

Jul. 26, 1974 [DE] Fed. Rep. of Germany ..... 2435971

[51] Int. Cl.[2] ..... B65H 45/22

[52] U.S. Cl. ..... 270/86; 270/21

[58] Field of Search ..... 270/86, 21, 5-7, 270/41, 65-66, 64, 94; 83/6-9, 346-348, 505

[56] References Cited

U.S. PATENT DOCUMENTS

| | | | |
|---|---|---|---|
| 517,693 | 4/1894 | Goss | 270/86 |
| 656,924 | 8/1900 | Bechman | 270/41 |
| 1,186,970 | 6/1916 | Cottrell | 270/86 |
| 1,887,331 | 11/1932 | Shomaker | 83/348 |
| 2,077,403 | 4/1937 | Eiseman | 270/86 |
| 2,107,462 | 2/1938 | Wood | 270/86 |
| 2,390,426 | 12/1945 | Davidson | 83/348 |
| 2,999,685 | 9/1961 | Burki | 270/86 |
| 3,200,687 | 8/1965 | Paulson | 83/505 |
| 3,570,335 | 3/1971 | Marin | 83/9 |

*Primary Examiner*—Edgar S. Burr
*Assistant Examiner*—A. Heinz
*Attorney, Agent, or Firm*—Flynn & Frishauf

[57] ABSTRACT

A folding triangle made of sheet metal is formed with a central opening through which a deformation roller, for example having teeth for perforation, or an edge for creasing of the paper web traveling over the folding triangle, is secured. A counter roller suitably shaped with respect to the deformation roller is located above the folding triangle, to be engaged by the deformation roller. The rollers are longitudinally as well as height adjustable. The apparatus is preferably associated with paper webs traveling through a printing machine.

14 Claims, 6 Drawing Figures

APPARATUS FOR LONGITUDINAL DEFORMATION, FOR EXAMPLE BY CREASING OR PERFORATION, OF PAPER WEBS PRIOR TO FOLDING

This is a continuation, of application Ser. No. 780,672, filed Mar. 23, 1977, which is a continuation of Ser. No. 596,448, filed July 16, 1975, both now abandoned.

The present invention relates to apparatus to deform paper webs being printed on in printing machines by creasing or perforating the paper web as it is being passed over a folding triangle or fold former by use of a roller and a counter roller.

Paper webs being worked on in printing machines are deformed in order to facilitate longitudinal folding of the paper webs issuing from the machine; such deformation is particularly desirable in heavier weight paper, deformation facilitating longitudinal folding by means of a triangular fold former if subsequent to longitudinal folding, transverse folding is to be carried out. If the deformation is to be by perforation, then the perforations should be so made that slight openings are formed in the paper having torn or shredded fringes extending outwardly of the paper when folded. The outward direction of the shreds or fringes permit escape of air upon subsequent folding, particularly upon subsequent transverse folding. They also permit accurate longitudinal folding since the shreds or fringes are not pressed at random towards the right or the left as they are passed over the tip of the forming triangle, which might cause lateral deflection of the paper web with respect to the forming triangle. Frequently, a plurality of paper webs are to be adhered at a predetermined adhesion line, and adhesive striping may be applied to the paper web at the outside of the crease to be formed in advance of the fold itself. Providing a crease prevents longitudinal shift of the paper web in the direction of the crease edge - when folded - thus improving adhesion of superimposed paper webs. Damage to the fold edge and formation of tears or fissures are effectively prevented.

It has previously been proposed to provide a separate pre-creasing roller or a perforating roller located in advance of the folding or forming section of a printing machine, driven counter the direction of rotation of the folding triangle inlet guide roller or guide cylinder. Providing such an additional roller requires additional drive apparatus, bearings, and substantially increases the overall height of the apparatus.

It is an object of the present invention to provide a paper-deforming, particularly perforating or creasing device which is so constructed that folding of a paper web is facilitated, which provides outwardly directed perforating fringes on the paper web, which is small and simple to operate and does not require additional power drive systems.

SUBJECT MATTER OF THE PRESENT INVENTION

Briefly, a roller pair is located on the forming or folding triangle itself; the perforating or creasing roller is located at that side of the folding triangle (which, as is customary, is made of sheet metal) which is surrounded by the paper as it is being folded over. Usually, this would be at the underside of a folding or forming triangle. The sheet metal element of the triangle is formed with a cut-out through which the deforming roller may extend. A counter roller is located immediately opposite the deforming roller and bears thereagainst. This arrangement prevents lateral shift of superimposed paper webs which are to be adhered together upon subsequent folding, thus improving adhesion of the paper webs. The apparatus can be constructed to be small and can be driven by frictional engagement with the traveling paper webs, thus not requiring any separate drive mechanism.

In accordance with a preferred embodiment, the deforming roller, that is, the perforating wheel or the creasing wheel, is located on a pivot arm which is adjustable with respect to the forming triangle counter the force of a spring, as well as being adjustable laterally thereof with respect to the center line of the folding triangle. Thus, the position of the crease or perforation to be formed with respect to the tip of the folding triangle is easily adjusted.

In accordance with a further feature of the invention, the deforming apparatus can be engaged and disengaged by securing the counter roller on a shaft in such a manner that either the counter roller or its attachment shaft is adjustable transversely of the forming triangle, the shaft being rotatable over a limited angular extent by means of a manually operable lever to lift the counter roller out of engagement with a paper web traveling over the folding triangle.

The invention will be described by way of example with reference to the accompanying drawings, wherein.

Figure 2:
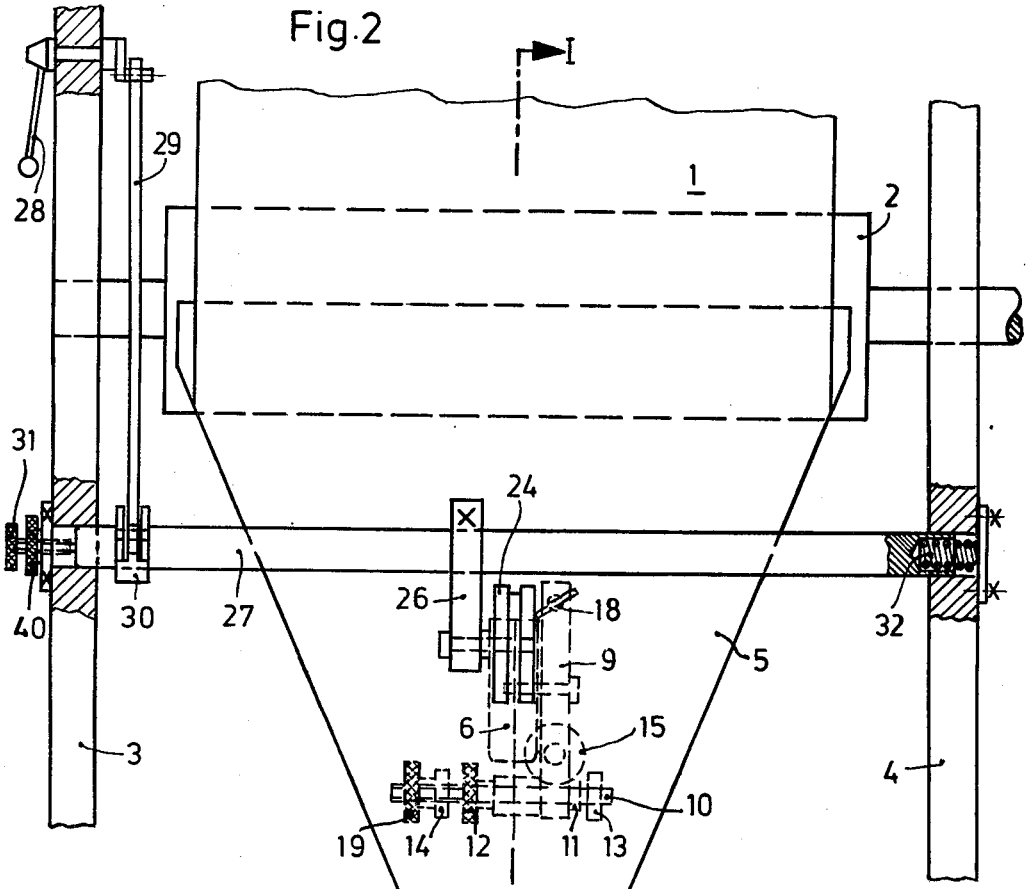
FIG. 2 is a top view of the apparatus of FIG. 1 in the direction of arrow A thereof.
Figure 3:
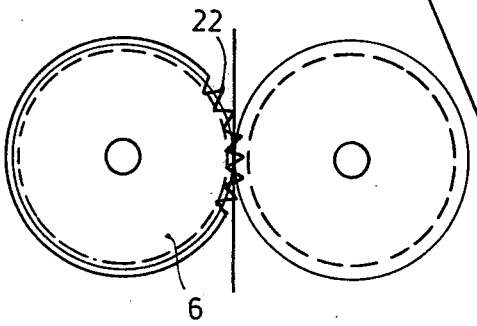
FIGS. 3 and 4 are side views and top views, respectively, of perforating roller pairs.
Figure 5:
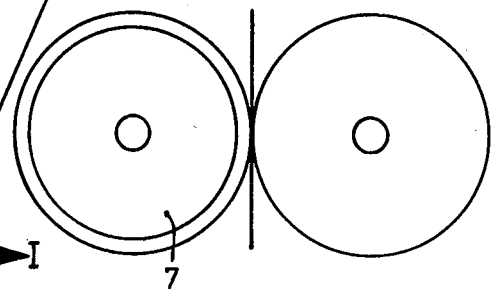
FIGS. 5 and 6 are side views and top views of creasing roller pairs.
Figure 6:
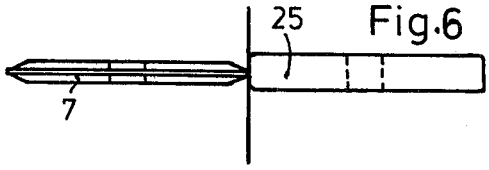

A paper web 1 is fed over the folding former feed roller 2, journalled in side walls 3, 4 of the machine to a folding or former triangle 5 having a first or upper side and an obverse or lower side. The paper web is longitudinally folded as it passes over the first side of the former triangle 5. In accordance with the present invention, the deforming roller, which may be a perforating roller 6 or a creasing roller 7, is located the obverse side of the folding triangle 5, i.e. at the side about which the paper web 1 will fold, that is, in the present instance at the bottom side thereof. The deforming roller is replaceable, so that either a creasing roller 7 (FIGS. 5, 6) or a perforating roller 6 (FIGS. 3, 4) can be placed thereon. The folding triangle 5 is formed with a cut-out 8 through which the deforming roller extends. The perforating roller 6, or the replaceable creasing roller 7 is journalled on a pivot lever 9 which is rotatably secured to a shaft 10. Shaft 10 has a hand-operated wheel 12 attached thereto as well as an adjustment ring 11 (FIG. 2). Shaft 10 is journalled in two bearing blocks 13, 14 (FIG. 2). Bearing block 13 has a smooth bore, whereas bearing block 14 is threaded. The shaft 10 is formed at the left-hand side, as shown in FIG. 2, with a thread, and by turning wheel 12, the thread on the shaft 10 can be engaged with the thread in bearing block 14, so that the position of the respective rollers 6, or 7, with respect to the center line, or apex of the folding triangle 5, can be adjusted by moving the entire lever 9 towards the right or left. The position of the lever 9 is fixed by a counter 19 threaded on shaft 10. The up-down movement of the respective deforming wheels 6, 7 in the direction towards or away from the folding triangle 5 or, rather, the cut-out 8 therein, is effected by means of a knurled nut 15 (FIG. 1), threaded on a threaded bolt 16 secured to the folding triangle 5. A spring 17 is interposed between the lever 9 and the folding triangle 5, the nut, when screwed towards the folding triangle, compressing the spring. A limit screw 18 limits the pivoting movement of lever 9.

Figure 4:
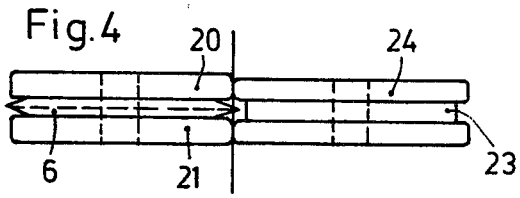

The perforating roller 6 (FIG. 4) is located between a pair of guide rollers 20, 21. Roller 6 is formed with peripheral teeth (see FIG. 3) which fit in a groove 23 formed in the counter roller 24 (FIG. 4). The creasing roller 7 (FIGS. 5, 6) is a single roller having a creasing edge which engages a counter roller 25 formed with a smooth and somewhat yielding or resilient surface, for example made of Vulkollan, or other yielding, smooth, rubber or plastic materials.

Figure 1:
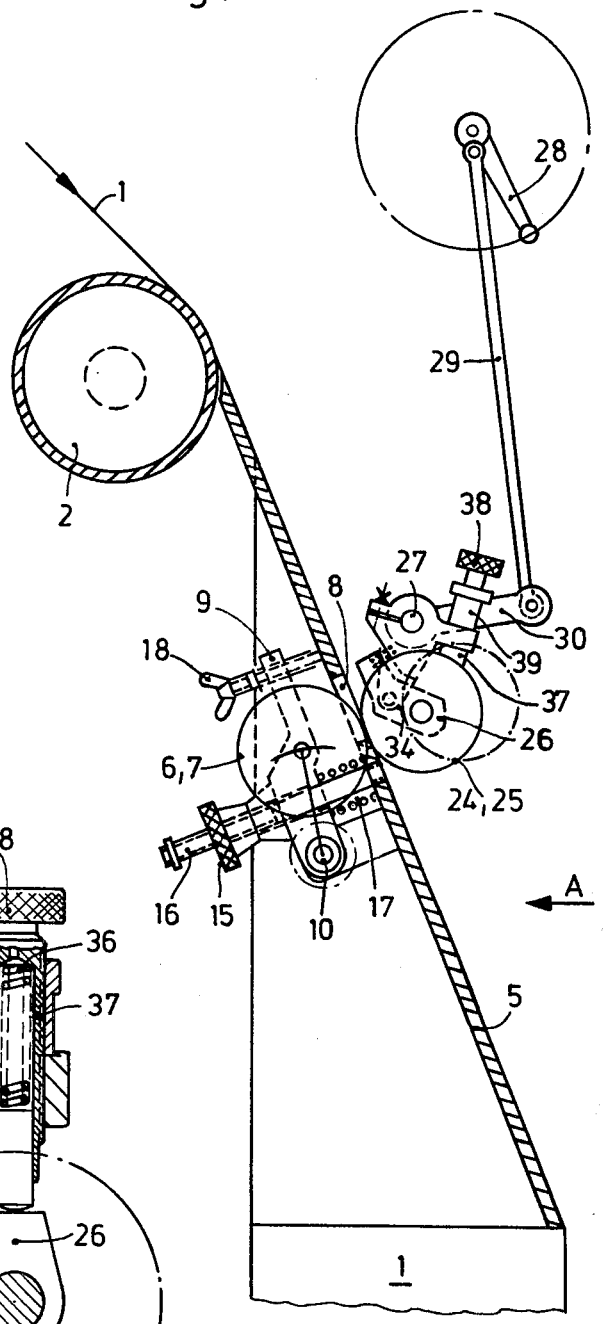
FIG. 1 is a highly schematic side view of the apparatus in accordance with the invention, partly in section, taken along line I—I of FIG. 2.
Figure 7:
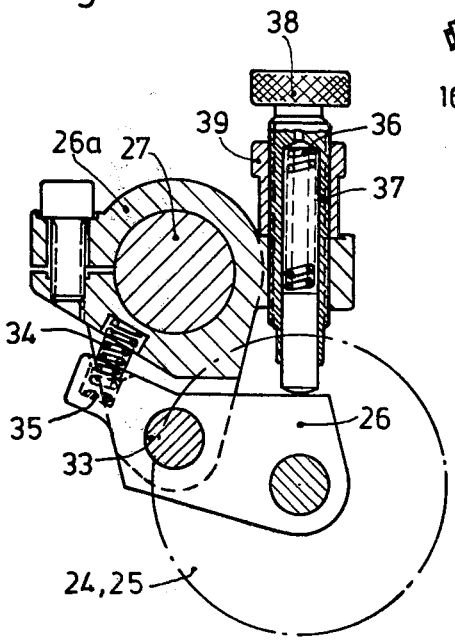
FIG. 7 is a detail side view illustrating attachment of the counter roller, to an enlarged scale.

The counter rollers 24, 25, to fit against the perforating roller 6, or the crease roller 7, respectively, are located on a two-part spring-loaded lever **26, 26*a* (FIGS. 1, 7). The part 26*a* of the spring-loaded lever is secured on a shaft 27 to be transversely adjustable (FIG. 2), so that the position of the respective counter roller can be adjusted with respect to the deforming roller which is used, and with respect to the transverse adjustment of this deforming roller. Both the deforming roller as well as the counter roller can, thereby, be accurately adjusted with respect to the apex of the folding triangle. A linkage which includes a hand lever 28 (FIGS. 1, 2) and a link 29 which is eccentrically mounted with respect to the hand lever 28 and connected to a holding lever 30 secured to shaft 27 permits rotation of shaft 27 by about 180°. The respective counter roller 24, 25 can thus be lifted from the position shown in solid lines in FIG. 1 to the position shown in chain-dotted lines in FIG. 1, that is, out of engagement with the paper web. As best seen in FIG. 7, lever 26 carrying the counter roller 24, 25 respectively is journalled in lever part 26*a* by a short shaft or rivet; a spring 35 fits into a depression 34 to resiliently press the end of lever 26 away from the part 26*a*. A compression spring 36 located within a hollow bolt 37, secured to the part 26*a*, permits engagement of the respective counter roller 24, 25 against the associated deforming roller 6, 7. Accurate adjustment is effected by means of a knurled knob 38 and a counter or stop nut 39, so that the counter rollers 24, 25 will maintain their respective adjustment with respect to the associated deforming rollers 6, 7. Fine adjustment, or correction of lateral position of the counter rollers 24, 25 is additionally effected by means of a pressure screw 31 which acts against one end of the shaft 27, the other end being longitudinally movable by being held in position by a spring 32 bearing against an end plate closing off the counter bore in side wall 4 of the machine. The adjusted position is locked or secured by means of a counter nut 40**.

Various changes and modifications may be made within the scope of the inventive concept.

The releasable attachment of the lever **26*a* (FIG. 7) on the shaft 27 permits coarse adjustment of the placing of the counter roller, so that former triangles having apex positions differing substantially from those shown in FIG. 2, for example, can be used with paper webs of varying width, or for different folding divisions. The former or folding triangles 5, themselves will carry on the underside the mechanism carrying the deforming rollers 6, 7, the position of the deforming rollers 6, 7 being adjustable with respect to the apex of the particular triangle used, and the position of the counter roller being coarsely adjustable by loosening of the lever elements 26*a* and sliding it into place, fine adjustment being provided by the arrangement including the nuts 31, 40**.

I claim:

1. Folding apparatus for one or a plurality of superimposed paper webs (1) which are guided over a folding triangle (5) having a center line terminating in a folding apex, a first side facing the paper webs, and an obverse side remote from the web, and including deformation apparatus having a roller pair (6, 24; 7, 25) including a deforming roller (6, 7) and a counter roller (24; 25), wherein the folding triangle comprises a folding element (5) formed with an opening (8) extending along the center line thereof; and deforming roller support means (9, 10) are provided located at the obverse side of the folding triangle and adjustabley supporting the deforming roller (6, 7) substantially centrally of the folding triangle (5), said deforming roller extending through said opening (8) from beneath the obverse side, said deforming roller support means comprising a pivot lever (9) and means journalling the deforming roller (6, 7) on the pivot lever, bearings (13, 14) secured to the folding element (5) and a shaft (10) secured in said bearings and pivotally holding said pivot lever therein, and means (12, 14) axially moving said shaft (10) with respect to said bearings and hence with respect to the location of said bearings on the folding element to adjust the position of the deforming roller (6, 7) transversely with respect to the apex of the folding triangle (5);

the counter roller (24, 25) being located at the first side of the folding triangle and being engageable with the deforming roller in the absence of a paper web between the deforming roller and the counter roller.

2. Apparatus according to claim 1, wherein the deforming roller comprises a perforating wheel (6) formed with peripheral teeth and a pair of guide rollers located adjacent respective sides of the perforating wheel;

the counter roller comprising a roller formed with a groove (23) into which the teeth of the perforating wheel (6) of the deforming roller fit;

and the deforming roller support means support said deforming roller in a position with the teeth extending through the opening 88) in the folding triangle (5).

3. Apparatus according to claim 1, wherein the deforming roller is a creasing roller (7) having a creasing edge, and the counter roller is a smooth roller (25) having a surface comprising elastic material.

4. Apparatus according to claim 1, wherein the roller support means comprises a pivot lever (9) and means journalling the deforming roller (6, 7) on the pivot lever;

bearings (13, 14) secured to the folding element (5) and a shaft (10) secured in said bearings and pivotally holding said pivot lever therein;

and means (12, 14) axially moving said shaft (10) with respect to said bearings and hence with respect to the location of said bearings on the folding element to adjust the position of the deforming roller (6, 7) transversely with respect to the apex of the folding triangle (5).

5. Apparatus according to claim 1, wherein two bearing elements are provided, one of the bearing elements (14) being threaded, and means (12) are provided to rotate the shaft with respect to said bearing element; and wherein the other bearing element (13) is smooth.

6. Apparatus according to claim 1, further comprising locking means (19) locking the shaft in adjusted position.

7. Apparatus according to claim 1, further comprising limit means (18) engageable by said pivot lever (9) to limit deflection thereof.

8. Apparatus according to claim 1, further including spring means (17) tending to press said pivot lever, and hence the deforming roller, away from the obverse side of the folding triangle (5);

and means (15, 16) pressing the pivot lever (9) counter the force of said spring (17) towards the obverse side of the folding triangle (5) to adjust the position of the circumference of the roller with respect to the first side of the folding triangle (5) and to control the extent of penetration of said deforming roller through the opening (8) in the folding triangle (5).

9. Folding apparatus having side walls (3, 4) to fold one or a plurality of superimposed paper webs (1) which are guided over a folding triangle (5) having a center line terminating in a folding apex, a first side facing the paper webs, and an obverse side remote from the web, and including deformation apparatus having a roller pair (6, 24; 7, 25) including a deforming roller (6, 7) and a counter roller (24; 25), wherein the folding triangle comprises a folding element (5) formed with an opening (8) with an opening (8) extending along the center line thereof;

deforming roller support means (9, 10) located at the obverse side of the folding triangle and adjustably supporting the deforming roller (6, 7) substantially centrally of the folding triangle (5), said deforming roller extending through said opening (8) from beneath the obverse side;

and counter roller support means located at the first side of the folding triangle comprising a spring-loaded lever (26, 26*a*);

a shaft (27) extending transversely of the center line of the folding triangle (5) and secured in the side walls (3,4) of the apparatus, said shaft being transversely movable between said side walls to permit fine adjustment of the position of the lever (26, 26*a*) with respect to the apex of the folding triangle (5), said lever (26) being releasably secured to said shaft;

and bearing means (26) to journal the counter roller (24, 25) supported by said spring-loaded lever (26, 26').

10. Apparatus according to claim 9, wherein said spring-loaded lever (26, 26*a*) comprises two pivotably connected elements (26, 26*a*) and at least two compression springs (35, 36) yieldingly adjusting the respective pivotal positions of the elements with respect to each other, one spring (36) being independently manually compressible for manual, spring-biassed adjustment of the position of the respective element with respect to the other element;

and wherein one element (26) is secured to the shaft (27) and the other element (26*a*) carries the counter roller (24), 25).

11. Apparatus according to claim 9, further comprising link means (28, 29, 30) linked to the shaft (27) and effecting rotation of said shaft by a limited angular extent upon movement of the link means.

12. Apparatus according to claim 9, wherein the deforming roller comprises a perforating wheel (6) formed with peripheral teeth and a pair of guide rollers located adjacent respective sides of the perforating wheel;

the counter roller comprising a roller formed with a groove (23) into which the teeth of the perforating wheel (6) of the deforming roller fit;

and the deforming roller support means support said deforming roller in a position with the teeth extending through the opening (8) in the folding triangle (5).

13. Apparatus according to claim 9, further comprising a spring (32) located on one of the side walls and axially bearing against said shaft (27);

and adjustable screw means (31, 40) acting on the shaft (27) with respect to the other side wall (3) to compress, or permit expansion of said spring to effect lateral adjustment of the shaft with respect to said side walls.

14. Apparatus according to claim 9, wherein the deforming roller is a creasing roller (7) having a creasing edge, and the counter roller is a smooth roller (25) having a surface comprising elastic material.

* * * * *